US008091204B2

(12) United States Patent
DiPietro

(10) Patent No.: US 8,091,204 B2
(45) Date of Patent: Jan. 10, 2012

(54) METHOD FOR PRODUCING METALLICALLY ENCAPSULATED CERAMIC ARMOR

(75) Inventor: Stephen DiPietro, Mont Vernon, NH (US)

(73) Assignee: Exothermics, Inc., Amherst, NH (US)

( * ) Notice: Subject to any disclaimer, the term of this patent is extended or adjusted under 35 U.S.C. 154(b) by 293 days.

(21) Appl. No.: 12/586,946

(22) Filed: Sep. 30, 2009

(65) Prior Publication Data

US 2011/0220281 A1 Sep. 15, 2011

Related U.S. Application Data

(63) Continuation-in-part of application No. 12/214,345, filed on Jun. 18, 2008.

(60) Provisional application No. 61/194,765, filed on Sep. 30, 2008, provisional application No. 60/936,425, filed on Jun. 20, 2007.

(51) Int. Cl.

| | |
|---|---|
| ***B25P 25/00*** | (2006.01) |
| ***F41H 5/02*** | (2006.01) |
| ***F41H 5/04*** | (2006.01) |

(52) U.S. Cl. ..... 29/458; 29/527.1; 29/527.2; 109/49.5; 109/84; 89/36.02; 89/36.05

(58) Field of Classification Search ..... 29/458, 29/527.1, 527.2; 109/49.5, 84; 89/36.02, 89/36.05; 432/9

See application file for complete search history.

(56) References Cited

U.S. PATENT DOCUMENTS

| | | | | |
|---|---|---|---|---|
| H001434 | H * | 5/1995 | Cytron | 89/36.02 |
| 6,860,186 | B2 * | 3/2005 | Cohen | 89/36.02 |
| 6,995,103 | B2 * | 2/2006 | Aghajanian | 501/88 |
| 7,067,031 | B2 * | 6/2006 | deWitt | 156/250 |
| 7,077,306 | B2 * | 7/2006 | Palicka et al. | 228/170 |
| 7,540,228 | B1 * | 6/2009 | Cronin et al. | 89/36.02 |
| 7,603,939 | B2 * | 10/2009 | Cohen | 89/36.02 |
| 7,617,757 | B2 * | 11/2009 | Dickson | 89/36.02 |
| 7,793,579 | B1 * | 9/2010 | Lee | 89/36.02 |
| 2002/0195030 | A1 * | 12/2002 | Christiansen et al. | 109/49.5 |

* cited by examiner

*Primary Examiner* — Jermie Cozart

(74) *Attorney, Agent, or Firm* — Paul C. Remus; Devine, Millimet & Branch

(57) ABSTRACT

A method for the manufacture of metallically encapsulated ceramic armor through the use of low pressure processing methods in autoclave furnaces or brazing furnaces.

8 Claims, 4 Drawing Sheets

METHOD FOR PRODUCING METALLICALLY ENCAPSULATED CERAMIC ARMOR

CROSS-REFERENCE TO RELATED APPLICATIONS

The present application claims the benefit of U.S. Provisional Patent Application Ser. No. 61/194,765 filed Sep. 30, 2008, which is incorporated herein by reference, and is a continuation-in-part of U.S. patent application Ser. No. 12/214,345 filed Jun. 18, 2008, which still pending and is incorporated herein by reference and which claims the benefit of U.S. Provisional Patent Application Ser. No. 60/936,425 filed Jun. 20, 2007.

FIELD OF THE INVENTION

The present invention relates to metallic encapsulation of lightweight ceramics for use in personnel and vehicular armor systems. More specifically, it relates to metallically encapsulated ceramic armor with enhanced ballistic efficiency, physical durability, multiple hit capability, structural integrity, and corrosion resistance.

BACKGROUND OF THE INVENTION

U.S. patent application Ser. No. 12/214,345, filed Jun. 18, 2008, which is still pending and incorporated herein by reference, describes a method for producing armor through metallic encapsulation of a ceramic core. In summary, this method involves first selecting a ceramic tile of the desired geometry; fabricating a conformal sheet metal container with dimensions modestly oversized relative to the ceramic tile; and placing the ceramic tile in the conformal sheet metal container and closing it. The closed conformal sheet metal container and a bed of granular material, which serves as a pressure transmission vehicle, are placed in an isostatic pressurization chamber. After the isostatic pressurization container is closed, degassed and hermetically sealed, it is subjected to temperature and pressure cycles that cause diffusion bonding of the ceramic tile and the conformal sheet metal container.

The method described in U.S. patent application Ser. No. 12/214,345 has many advantages over the prior art. It is less complicated, less costly, capable of working with a wide range of metal and ceramic materials combinations, and also compatible with the requirements of reproducible and large-scale manufacturing. However, the method requires a hot isostatic pressurizing step, or high pressure step, which is complex and expensive.

It is an object of the present invention to use lower pressure methods for bonding metals, such as titanium, aluminum and magnesium, to ceramics, such as silicon carbide, boron carbide, titanium diboride, and alumina. Lower pressure processing methods will allow the use of lower cost, much more widely available, autoclaves or brazing furnaces.

The use of these lower pressure bonding methods is based on the use of a "wetting" braze with a relatively low temperature melting point (herein defined as an "interlayer material"), as exemplified by aluminum 4047 alloy. Because it appears that an interlayer material, such as aluminum 4047 alloy, produces effective wetting of both the metal and ceramic, the relatively low melting point interlayer material produces an effective bonding. In other words, it is not necessary to depend exclusively on diffusion bonding, as it is classically carried out in a hot isostatic press, which entails use of relatively high temperatures and high pressures, to initiate plastic flow and chemical diffusional bonding at interface. In effect, a properly designed interlayer material with the right technical properties can achieve many of the same attributes that result from high pressure diffusion bonding.

The present invention is a method for joining titanium, aluminum or magnesium sheet to armor ceramics using an autoclave furnace, which works at a few hundred psi, or even a conventional brazing furnace, which works at atmospheric or slightly positive pressure. The key for making the low pressure bonding work is to have an interlayer material and a soft, ductile metallic foil "bag" (herein defined as a "metallic bag") that can be vacuum sealed. The parts to be bonded, here a ceramic tile, an interlayer material and conformal sheet metal container, are placed in a metallic bag, the metallic bag is sealed and evacuated, and the metallic bag is placed into an autoclave or brazing furnace.

SUMMARY OF THE INVENTION

The present invention, as shown in the flow chart in FIG. 1, is a method for producing metallically encapsulated ceramic armor. In summary, this method involves first selecting a ceramic tile 1 of the desired ceramic and geometry; fabricating 2 a conformal sheet metal container of the desired metal with dimensions modestly oversized relative to the ceramic tile; placing 3 the ceramic tile and a selected interlayer material in the conformal sheet metal container; and closing 4 the container. The closed conformal sheet metal container is placed 5 in a metallic bag. After the metallic bag is closed, degassed and hermetically sealed 6, it is heated 7 in an autoclave or brazing furnace.

The present invention produces metallically encapsulated ceramic armor with excellent shear properties and good physical durability. Since the invention in its most basic form involves the use of commercially available sheet metal material for encapsulation, the areal density of the encapsulated armor is extremely repeatable and controllable. It is limited only by the availability of suitable sheet metal products. The articles produced from this invention can also be produced with varying degrees of lateral or hydrostatic confinement by simply varying the thickness and physical properties (i.e., coefficient of thermal expansion, elastic modulus). Other properties such as corrosion resistance and weldability can also be tailored to the engineering requirements of a given system by choosing a suitable pure metal or alloy. For example, metallically encapsulated ceramic armor with excellent corrosion resistance in marine or salt spray environments can be produced by using Grade 2 titanium or suitable alpha or beta titanium alloys as the encapsulating material, thus simplifying maintenance and logistical requirements for the armor system.

It will be understood that the present invention is not limited to being practiced with titanium, aluminum or magnesium alloys as the encapsulating material. Any metal layer that is thermodynamically compatible with the underlying ceramic tile and can be formed by standard sheet metal or similar metallurgical forming methods is a potential candidate. Among the metals that could be considered are titanium, aluminum, magnesium, steel, nickel, tantalum, zirconium or niobium. Intimate contact and bonding, the degree of which can be controlled by suitable application of processing parameters and interlayer material, is brought about by suitable temperature and pressure. The conditions needed to bond metallic encapsulating sheet metal layers, interlayer material substrates, and ceramic armor substrates are developed for each materials combination of interest, largely based on factors such as melting point.

Metallically encapsulated ceramic armor articles formed by the method of the present invention can have tailored thermal expansion and elastic modulus behavior providing for a controllable degree of lateral and/or hydrostatic confinement on the ceramic armor tiles to which they are bonded. This affords the possibility to optimize a given materials system according to the dictates of a given penetration mechanics or finite element structural model.

These and other features and advantages of the present invention will be better understood by reading the following detailed description of a preferred embodiment, taken together with the figures incorporated herein.

DETAILED DESCRIPTION OF PREFERRED EMBODIMENTS

The present invention is a method for metallic encapsulation of ceramic tiles to produce armor. A preferred embodiment of the method begins with selecting a ceramic tile of the desired geometry, which may include, for example, a flat plate or a torso plate. Examples of ceramic materials include, but are not limited to, silicon carbide, boron carbide, and alumina. The preferred embodiment here employs a silicon carbide tile.

Figure 1:
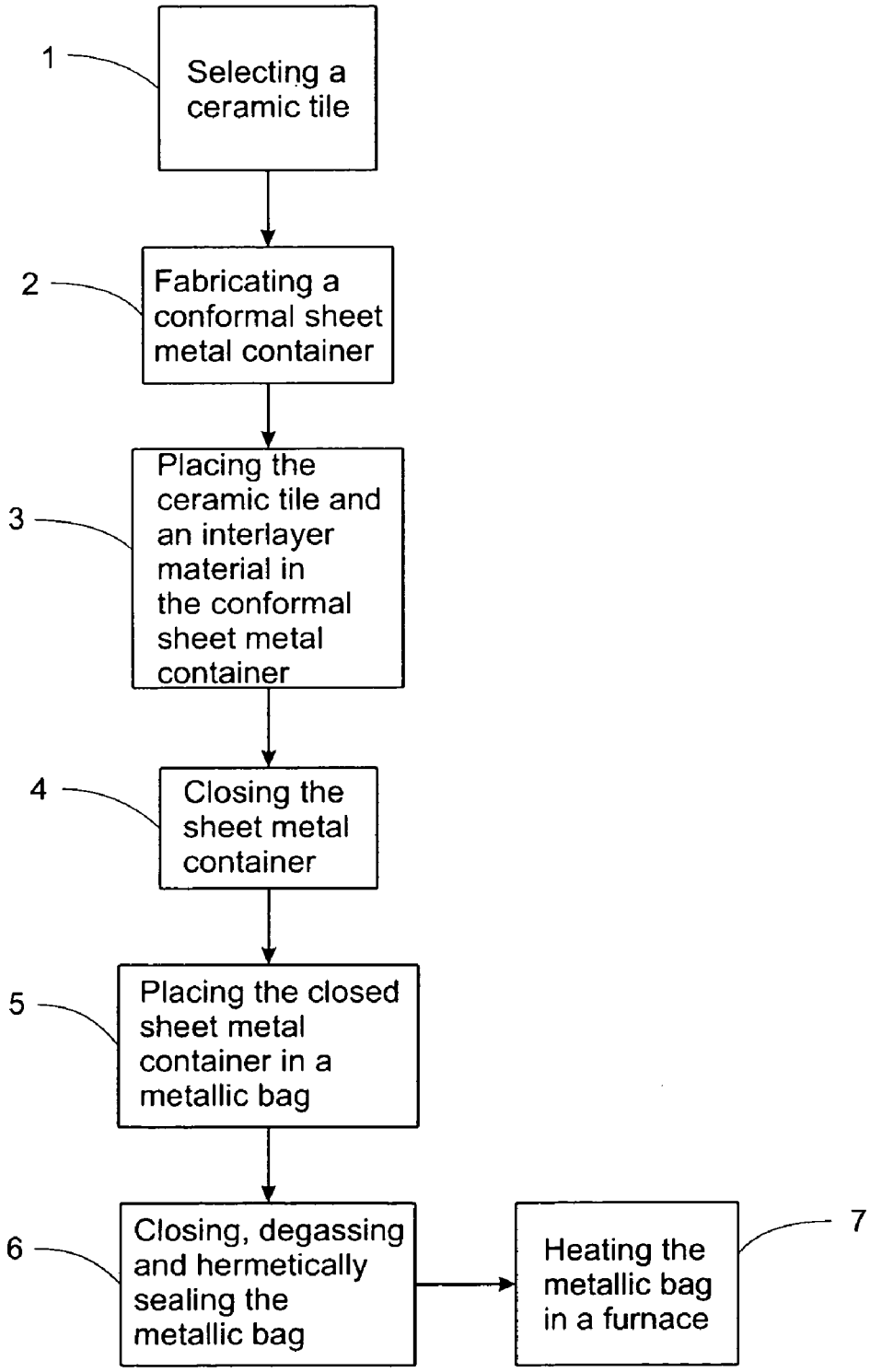
FIG. 1 shows a flow chart of the method of the present invention.
Figure 2:
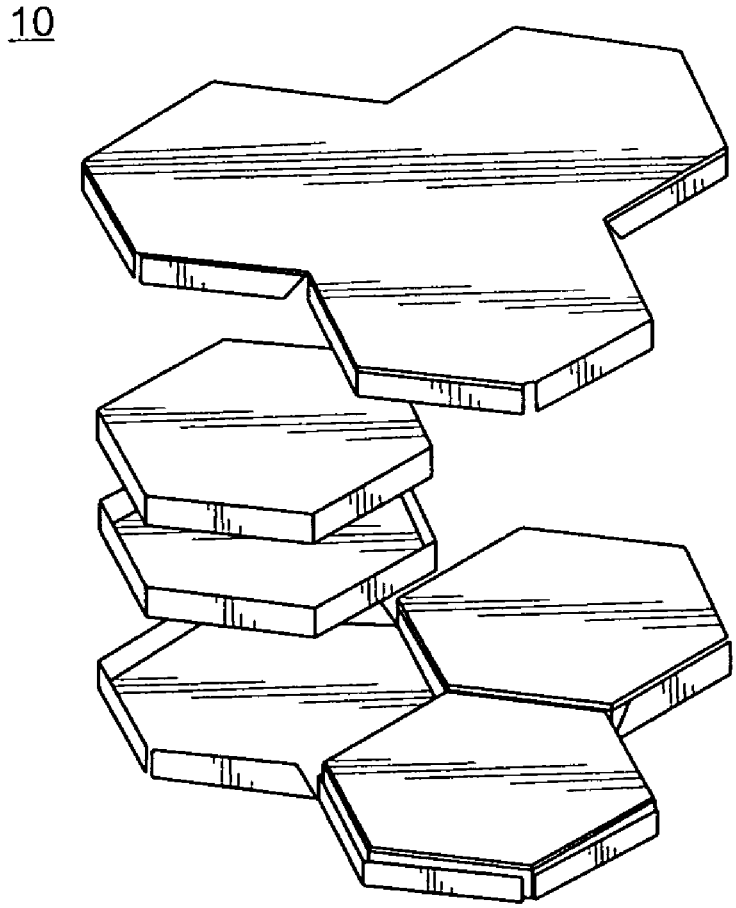
FIG. 2 shows the sheet metal forming techniques used to produce a (double) encapsulated hexagonal ceramic tile array.

The preferred embodiment then comprises the fabrication of a conformal sheet metal container, wherein suitable sheet or plate stock ranging from 0.005" (0.0127 cm) to 0.250" (0.635 cm) in thickness is made in the shape of the ceramic tile to be encapsulated. The sheet metal envelope can be formed by methods such as brake-forming, shearing, hydroforming, deep drawing, stamping or superplastic forming. The conformal sheet metal container is made with dimensions that are modestly oversized relative to the ceramic tile [+0.005"-0.010" (0.0127-0.0254 cm)] so that the container fits comfortably around the ceramic tile, facilitating easy assembly. An example of a sheet metal container design 10 that allows for double encapsulation of individual hexagonally shaped ceramic tiles, as well as a three-tile array, is shown in FIG. 2. This basic design can readily be adapted to different shapes such as rectangular or cylindrical tiles, as forming methods such as brake-forming, automated punching, stamping and spinning may be advantageously employed for fabrication of essentially an infinite variety of sheet metal container shapes. Additionally metallic encapsulation of even larger tile arrays can be done by replicating unit cells of containers that enclose multiple ceramic tiles.

Any suitable metal capable of being plastically formed using standard sheet metal forming techniques is a potential candidate for encapsulation of ceramic tiles to produce armor. Titanium, aluminum, and magnesium alloys have all been successfully employed, and it is obvious to those trained in the art that other metals, such as niobium, tantalum, copper, chromium, nickel, steel and zirconium, would also work well. The preferred embodiment here employs a titanium sheet metal container.

The ceramic tile is then placed in the sheet metal container with a suitable interlayer material. The interlayer material "wets" both the metal of the sheet metal container, in the preferred embodiment titanium, and the ceramic of the ceramic tile, in the preferred embodiment silicon carbide. By wetting, it is meant that a molten drop of the interlayer material on the metal or ceramic shows a sessile drop angle of less than ninety degrees. This means the droplet is spreading, probably chemically interacting with the metal and the ceramic, and flowing into narrow spaces well.

The interlayer material can be applied to the metal or ceramic as a paste or putty, if available in that form. Alternatively, some interlayer materials, such as aluminum 4047 alloy, are available in the form of foil. In the preferred embodiment, in which aluminum 4047 alloy foil is used, the entire package can be assembled like a sandwich with the sheets of interlayer material foil in between the metal and the ceramic. The conformal sheet metal container is then closed, typically with a full-lap or half-lap joint applied on the ninety degree portions of the bend, as seen in FIG. 2. Such a fabrication approach provides for full encapsulation of the ceramic tile edges and good lateral confinement of the ceramic tile during impact. Edges are also protected against accidental impact using this container design. For initial fit-up purposes, tack welds using TIG or MIG methods are typically employed at all open corner seams although this is not an absolute necessity for the encapsulation to function successfully. The sheet metal container is then tack-welded to initial closure.

The conformal sheet metal container is then placed in a metallic bag that is seam welded and then evacuated. The metallic bag may be made out of a number of materials. It needs to have a high enough melting point to survive the bonding cycle (typically the melting point of the interlayer material); it needs to be amenable to vacuum-tight seam welding; and it needs to have adequate ductility to survive furnace processing. Examples of suitable metallic bag materials include, but are not limited to, mild steel and stainless steel. The preferred embodiment here employs a stainless steel metallic bag.

Figure 3:
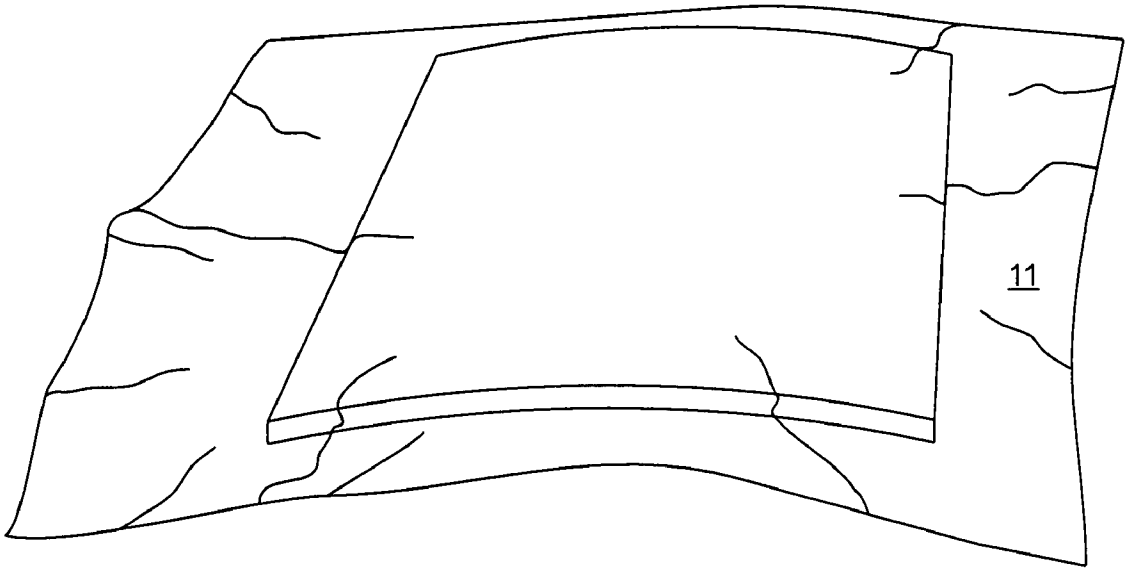
FIG. 3 shows a metallic bag containing a curved ceramic armor tile in a conformal sheet metal container.
Figure 4:
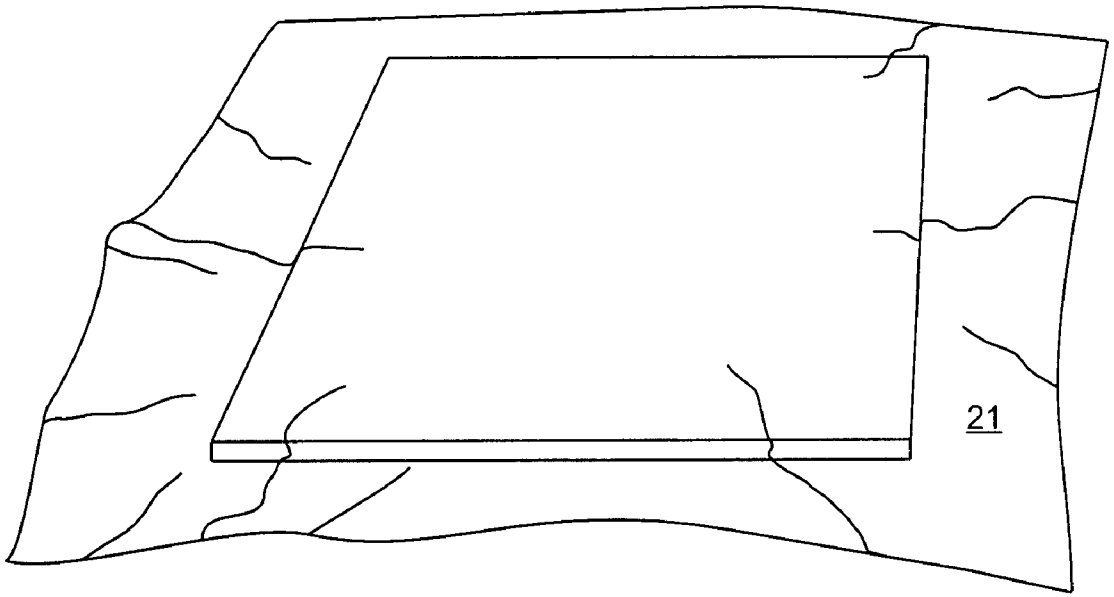
FIG. 4 shows a metallic bag containing a flat ceramic armor tile in a conformal sheet metal container.

FIG. 3 shows a curved conformal sheet metal container 10 holding a curved ceramic tile, and FIG. 4 shows a flat conformal sheet metal container holding a flat tile, each in a separate, individually vacuum sealed, metallic bag 11, 21, respectively. In the preferred embodiment, the silicon carbide ceramic tile and the 4047 alloy interlayer material are placed in the Ti conformal sheet metal container, which is then put in a 0.002" stainless steel metallic bag that is seam welded on three sides. The metallic bag is pumped out to remove all the air and moisture and then sealed when it is properly evacuated. The sealed metallic bag can then go into a brazing furnace (which effectively provides 15 psi of overpressure since the outside of the bag is at ambient pressure and the inside is under vacuum), or, alternatively, in a suitably equipped autoclave so as to provide a few hundred psi of overpressure outside the bag. The metallic bag is typically held just above the melting point of the interlayer material. For a material such as aluminum 4047 alloy, which has a eutectic melting composition of about 577 C, a preferred embodiment customarily bonds at temperatures of about 600 C. Anywhere from about 15-20 C above the interlayer melting point is typical. When the interlayer material melts, it flows and bonds the ceramic tile and the sheet metal together.

The mechanism of interlayer material bonding to the metal and the ceramic is via formation of intermetallic or intermediate phases that chemically bond the interlayer material to the ceramic and the metal. In the case of the aluminum 4047 alloy (which is 88% aluminum and 12% silicon) of the preferred embodiment, on silicon carbide, one would expect some mullite ($SiO_2$:$Al_2O_3$), some $Al_4C_3$ and possibly some free Si. On titanium, one would expect phases like TiAl, $Al_3Ti$, $TiSi_2$, etc. which will form during the brazing process. This will also promote bonding, which needs some chemical interdiffusion of the interlayer material and both the ceramic and the metal portions of the laminate. However, it is important to avoid an excessive amount of intermetallic phase since many of these are brittle. It is necessary to establish custom bonding cycles for each specific materials combination.

The advantage of the metallic bag method of the present invention relates to simplicity and cost reduction. It also lends itself to automation and large volume production.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A method of metallically encapsulating a ceramic core to produce armor comprising:

selecting a ceramic tile, fabricating a conformal sheet metal container, placing the ceramic tile and an interlayer material in the conformal sheet metal container and closing the sheet metal container, placing the closed conformal sheet metal container in a metallic bag, closing, evacuating and sealing the metallic bag, subjecting the metallic bag to temperatures that cause the interlayer material to melt and bond the ceramic tile and the conformal sheet metal container.

2. The method of claim 1 wherein the ceramic tile is comprised of a ceramic selected from the group consisting of alumina, boron carbide, silicon carbide and titanium diboride.

3. The method of claim 1 wherein the conformal sheet metal container is comprised of a metal selected from the group consisting of titanium, aluminum, magnesium, steel, nickel, tantalum, zirconium, and niobium.

4. The method of claim 1 wherein the interlayer material wets the ceramic of the ceramic tile and the metal of the sheet metal container.

5. A method of metallically encapsulating a ceramic core to produce armor comprising:

selecting a ceramic tile, fabricating a conformal sheet metal container, placing the ceramic tile and an interlayer material in the conformal sheet metal container and closing the sheet metal container, placing the closed conformal sheet metal container in a metallic bag, closing, evacuating and sealing the metallic bag, placing the metallic bag in a furnace chamber, causing the interlayer material to bond to the ceramic tile and the conformal sheet metal container.

6. The method of claim 5 wherein the furnace is capable of providing controlled temperatures up to peak temperature of 1,000° C.

7. The method of claim 5 wherein the furnace is a brazing furnace.

8. A method of metallically encapsulating a ceramic core to produce armor comprising:

selecting a ceramic tile, fabricating a conformal sheet metal container, placing the ceramic tile and an interlayer material in the conformal sheet metal container and closing the sheet metal container, placing the closed conformal sheet metal container in a metallic bag, closing, evacuating and sealing the metallic bag, causing the interlayer material to bond the ceramic tile to the sheet metal container.

* * * * *